United States Patent [19]

Crossfield

[11] Patent Number: 4,992,776

[45] Date of Patent: Feb. 12, 1991

[54] ANTIPILFERAGE TAGS AND THEIR USE

[76] Inventor: Michael D. Crossfield, Clare House, Halse, Brackley, Northamptonshire, England, NN13 6DY

[21] Appl. No.: 335,493

[22] Filed: Apr. 10, 1989

[30] Foreign Application Priority Data

Apr. 8, 1988 [GB] United Kingdom ..... 8808244
Apr. 8, 1988 [GB] United Kingdom ..... 8808245
Apr. 29, 1988 [GB] United Kingdom ..... 8810177

[51] Int. Cl.[5] ..... G08B 13/18

[52] U.S. Cl. ..... 340/551; 310/118; 340/572; 340/384 E

[58] Field of Search ..... 340/551, 572, 384 E; 310/118

[56] References Cited

U.S. PATENT DOCUMENTS 3,781,664 12/1973 Rorden ..... 340/572
4,335,377 6/1982 Boslic ..... 340/384 E
4,812,811 3/1989 Äsbrink et al. ..... 340/572

*Primary Examiner*—Glen R. Swann, III
*Attorney, Agent, or Firm*—Sixbey, Friedman, Leedom & Ferguson

[57] ABSTRACT

A housing contains a pick-up coil for detecting an external magnetic field; a power supply; a tone generator; and an electric circuit powered by said power supply and arranged to activate said tone generator in response to an output from said magnetic field pick-up including a piezoelectric material surrounded about its circumference by a thin layer of magnetostrictive material. Since the electrical output of the piezoelectric material is dependent on the stress imparted to it by the magnetostrictive material, and since the dimensional change in the magnetostrictive material is proportional to the magnetic field in the environment in which the magnetostrictive material is located, the electrical output of the piezoelectric material provides a measure of magnetic field strength.

7 Claims, 3 Drawing Sheets

Fig. 3.
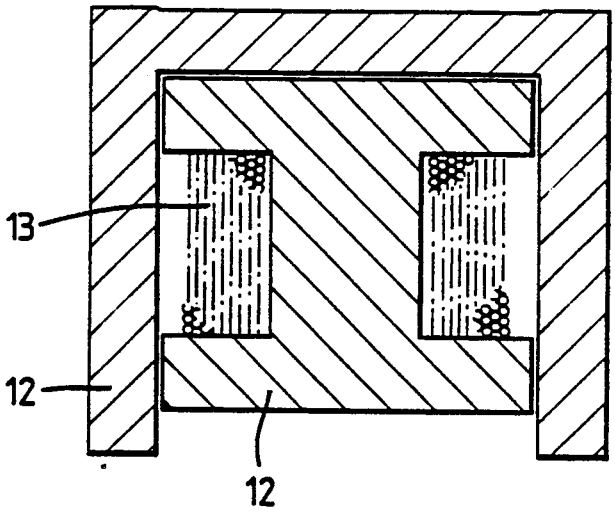
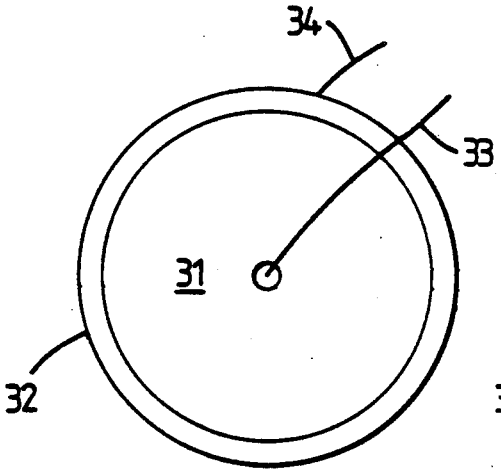
Fig. 4A
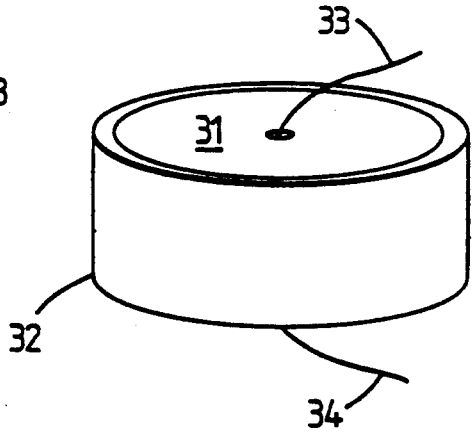
Fig. 4B

ANTIPILFERAGE TAGS AND THEIR USE

BACKGROUND OF THE INVENTION

This invention relates to antipilferage tags or markers. Such tags are applied to articles of commerce in order to protect them from theft at the point of sale premises. Typically, the tag is a magnetic medium which is deactivated when a shop assistant carries out a routine procedure at the time of effecting a sale. Such deactivation prevents detection of the magnetic tag when it (and the article to which it is attached) pass through a detection system, typically in the form of a walk-through framework which emits an alternating magnetic interrogation field. This field is designed to interact with a tag prior to deactivation and, in substantially all known prior systems, to cause a warning signal to be emitted in the event that detection of a non-deactivated tag occurs.

SUMMARY OF THE INVENTION

The prevent invention relates more particularly to a magnetic antipilferage tag which incorporates 'active' circuity whereby the tag itself is able to generate an alarm signal when it passes through an interrogating field (e.g. emitted by an interrogating gate) without first having been deactivated at a point of sale by a sales assistant. Thus, in contrast to the conventional type of system, in the present invention it is the magnetic tag which generates an alarm in response to an interrogating field, rather than the interrogating gate through which a customer passes at or after leaving a point of sale. For this reason, a magnetic antipilferage tag in accordance with this invention may be termed an "active tag".

According to the present invention, there is provided a magnetic antipilferage tag which comprises a housing containing means for detecting an external magnetic field; a power supply; a tone generator; and an electric circuit powered by said power supply and arranged to activate said tone generator in response to an output from said magnetic field detector means.

The magnetic field detector means advantageously operated by inductive coupling. One or more pick-up coils may be used for this purpose.

One form of field sensor provided by this invention comprises a piezoelectric material having disposed about it a magnetostrictive material such that in the presence of a magnetic field the magnetostrictive material imparts compression or tension to the piezoelectric material, thereby generating an electrical output from the piezoelectric material.

Since the electrical output of the piezoelectric material is dependent on the stress imparted to it by the magnetostrictive material, and since the dimensional change of a magnetostrictive material is proportional to the magnetic field in the environment in which the magnetostrictive material is located, then the elctrical output of the piezoelectric material provides a measure of magnetic field strength.

The piezoelectric material will conveniently be provided with electrical connections. The piezoelectric material is advantageously in the form of a cylinder or circular disk with the magnetostrictive material disposed about the circumference thereof. Electrical connections can then be provided on opposite faces of the cylinder or disk. Other configurations may also be adopted if desired.

The magnetostrictive material need not completely cover the pieoelectric material or that surface of the piezoelectric material with which it is in contact. Nevertheless, a band of magnetostrictive material surrounding the piezoelectric material is preferred.

The magnetostrictive material can be deposited by any suitable technique onto the surface or onto surface regions of the piezoelectric material; for example, the magnetostrictive material can be deposited about the circumference of a cylinder or disk by a vapour deposition process, e.g. sputtering.

Preferably, the electric circuit in the tag of this invention is a low-power CMOS integrated circuit. The tone generator is preferably a piezo-electric sounder; suitable devices of this type are available commercially from a number of manufacturers (e.g. Murata and Toko of Japan), either as unmounted units, or fitted to resonant acoustic enclosures. They provide high audio output and efficiency together with small size and low weight. A typical device can generate a sound pressure at resonance of more than 80 dBA at one meter while consuming less than 10 mWatts.

In one beneficial embodiment, a resonant acoustic enclosure for a piezo-electric tone generator is moulded into the overall casing of the tag. Once activated the active tag will continue to emit an alarm tone until the battery is exhausted or the tag is disabled. It is clearly undesirable to have an easily accessible disabling switch, and in one preferred embodiment the electric circuit within the label is arranged to detect a specially modified form of the interrogation signal in such a way as to reset the device to its untriggered state. An example of a simple "deactivation" signal would be a carrier at the interrogation frequency, amplitude modulated with a fixed mark/space ratio. Clearly many other forms of modulation could be used, complex types giving high security against unauthorised disablement by technically knowledgable thieves.

Preferably, the active tag also comprises means allowing removable attachment of tag to an article of merchandise. In one embodiment the attachment means is able to interact with the circuitry within the tag whereby unauthorised removal of the tag from the item of merchanidse activates the tone generator to sound an alarm. Authorised removal would be in the presence of the deactivation signal described above, thereby preventing the alarm's being given.

The active tag may also be constructed in such a manner that penetration of the body of the tag, crushing the tag or violent shock results in electrical connections being made or broken, these in turn activating the alarm.

BRIEF DESCRIPTION OF THE SEVERAL FIGURES

For a better understanding of the invention, and to show how the same may be carried into effect, reference will now be made, by way of example, to the accompanying drawings, in which:

FIG. 3 illustrates a typical construction for an inductor forming part of the tag; and FIGS. 4A and 4B are illustrations of one type of magnetic field sensor for use in the invention.

DETAILED DESCRIPTION OF THE PREFERRED EMBODIMENT

Figure 1:
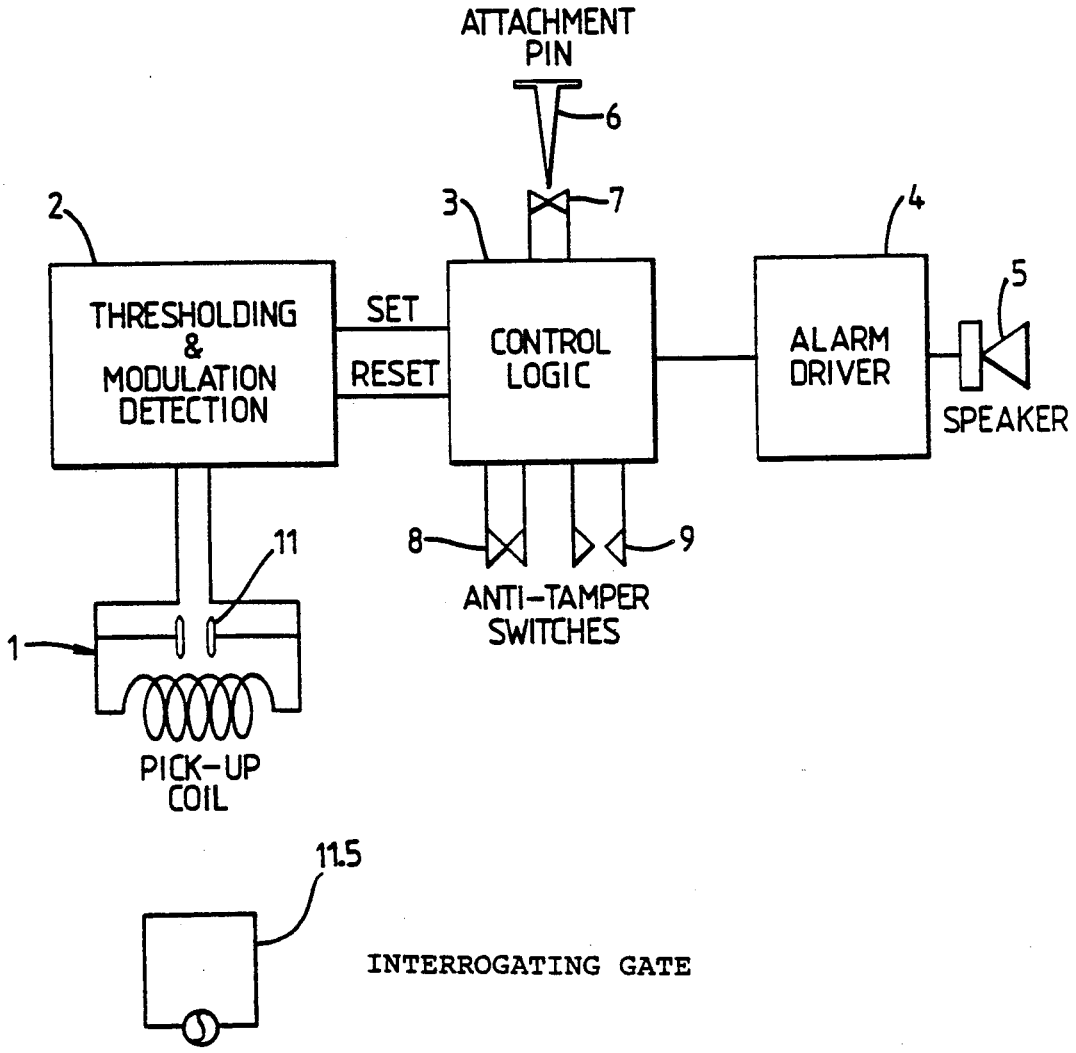
FIG. 1 is a block diagram of one embodiment of an active tag of this invention.
Figure 2:
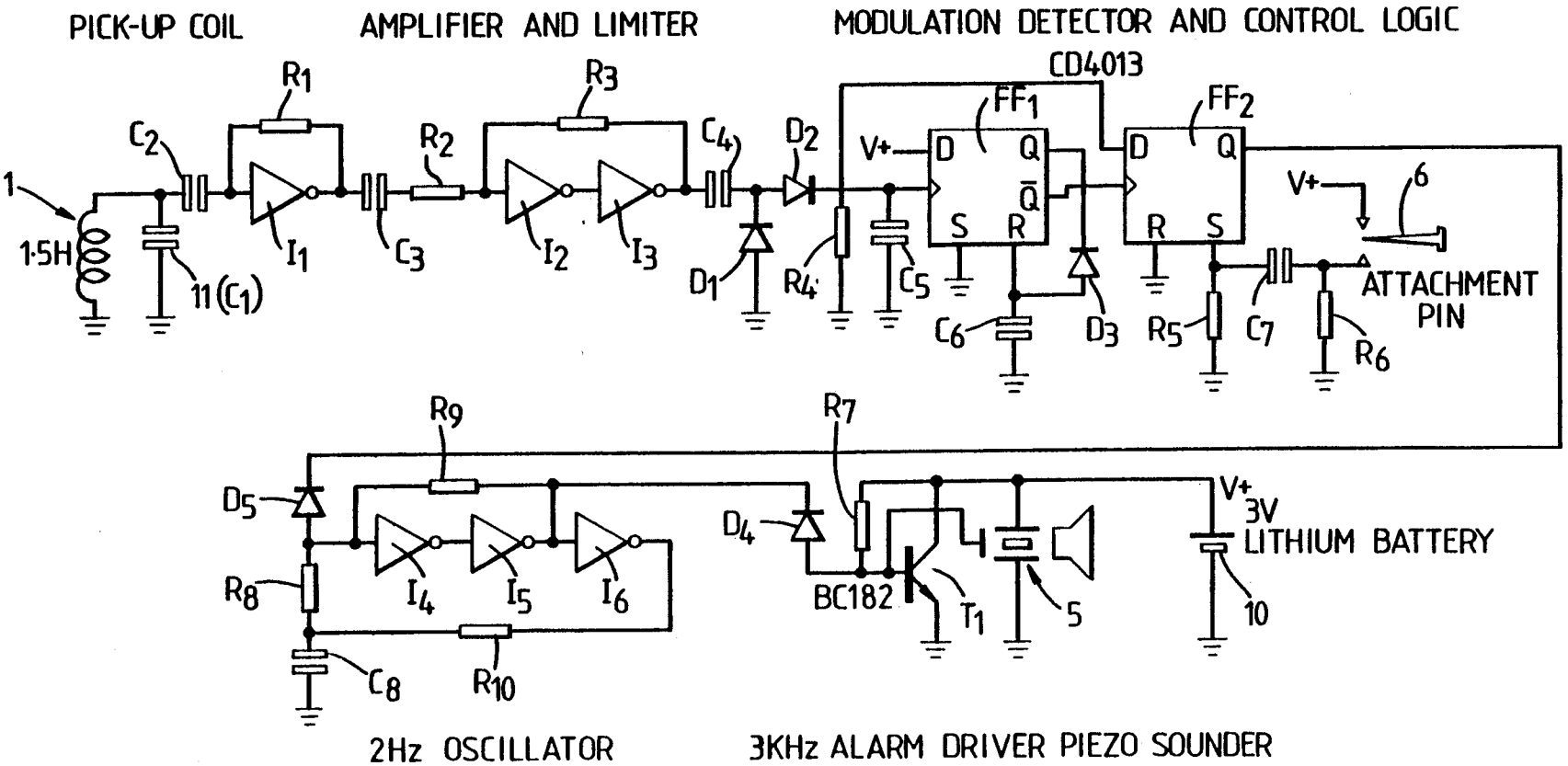
FIG. 2 is a circuit diagram corresponding to FIG. 1.

Referring now to FIGS. 1 and 2 of the drawings, the active tag comprises a magnetic field detector 1 in the form of three pick-up coils 1 (of which only one is shown in the drawings). The output from the pick-up coils 1 is fed to a thresholding and modulation detection circuitry 2. Here, the output from pick-up coils 1 is amplified and, when the signal exceeds a predetermined threshold, a rectified output signal is fed to a control logic unit 3 and an alarm driver 4. When activiated, alarm driver 4 generates a tone signal which is fed to a piezoelectric loudspeaker which may be enclosed within a resonant chamber 5.5.

In use, the tag is designed to be attached to an article of merchandise by means of an attachment pin 6 which closes contacts 7, thereby rendering the tag operative. Anti-tamper switches 8 and 9 are also included; these functions to activate the alarm driver 4 if the tag is damaged or improperly removed from the merchandise which it is protecting. Switch 8 may be located, for example, so that its contacts are opened if the tag is torn from the merchandise; switch 9 is located so that an attempt to crush the tag will close its contacts. The result, in each case, is actuation of alarm driver 4.

The power supply within the active tag is preferably a miniature long-life battery 10 (see FIG. 2). Particularly suitable types are alkaline or lithium button cells, the former having shelf lives of 2 years, the latter 5 years. Using suitable low power electronic design, a cell with a capacity of 50 mAh will typically power the untriggered tag for periods in excess of the cell's shelf life. In the event of the tag's being triggered, this cell will provide many minutes of alarm. Power consumption during emission of an alarm signal can be reduced by incorporating a circuit which causes the tone signal to 'bleep'-this may be done, for example, by interposing a 2 Hz oscillator circuit between the control logic and the alarm driver. This further extends the alarm operating time.

The basic circuit of FIG. 2 comprises invertors $I_1$, $I_2$ and $I_3$; capacitors $C_1$–$C_7$, of which $C_1$ is the capacitor 11 of FIG. 1; resistors $R_1$–$R_7$; diodes $D_1-D_4$; D-type flip-flops $FF_1$ and $FF_2$; transistor $T_1$; and piezosounder 5. In addition, a 2 Hz oscillator circuit comprises invertors $I_4$–$I_6$: capacitor $C_8$; resistors $R_8-R_1O$; and diode $D_5$. Power is supplied by the 3 v lithium button battery 10.

In use the pick-up coil or coils 1 are arranged to couple inductively with an alternating magnetic field generated, for example, by an interrogating gate 11.5 which includes a coil or loop (typically enclosing an area of several square feet) connected to an alternating current generator. Preferably the alternating current is in the frequency range 1–10 KHz. The amplitude of the magnetic field created in this way diminishes very rapidly with distance from the coil or loop thereby giving a well defined interrogation zone, and there is no significant radiation of a propagating electromagnetic signal.

Certain designs of pick-up coil are particularly advantageous for this application. In particular a spiral coil manufactured by photolithographic and etching techniques, such as are used in the production of printed circuit boards, is both cheap to manufacture, and convenient from an assembly viewpoint.

Another particularly beneficial configuration is illustrated in FIG. 3. This uses a high-value, high "Q" ferrite cored inductor, resonated with a suitable frequency. Suitable devices are available commercialy from manufacturers such as Toko of Japan. A typical unit has an inductance of 1.5 Henry and a Q of 30 at 5 KHz. These units achieve their high inductance largely because the ferrite core material 12 forms a closed loop around the coil windings 13. The effective permeability of the core is thus very high. In theory a closed magnetic core has very low coupling to external fields. However, it has been found that the non-uniform cross-section and form of certain cores causes appreciable external coupling, and a usefully large signal can be developed across the coil, especially at resonance. As an example, on particular 1.5 Henry inductor, resonated at 5 KHz, provided an open circuit voltage of 2 volts peak to peak in an alternating 5 KHz magnetic field of 20 Amps/meter.

To achieve omni-directionality of minimum of three coils is necessary, positioned in mutually, orthogonal directions. In this instance it is additionally beneficial to mount the coils in close proximity, whereby the ferrite cores of the different inductors interact so as to further distort the uniformity of the individual magnetic circuits. In this way the received signal amplitude can be further increased.

FIGS. 4A and 4B illustrate a simple embodiment of a magnetic field detector in accordance with this invention. This device may be used in the tag in place of the pick-up coils described above. A right circular cylinder 31 is formed of a piezoelectric material and is surrounded about its circumference by a thin layer 32 of a magnetostrictive material. Electric contacts 33 and 34 are attached to the material 31 to allow the electrical output to be measured, this being proportional to the magnetic field strength prevailing at the time and place of measurement.

In another aspect the invention provides an antipilferage system comprising an active tag as defined hereinabove, and an interrogating gate comprising a coil of electrically conductive material and an alternating current generator connected to said coil.

I claim:

1. A magnetic antipilferage tag which comprises a housing containing means for detecting an external magnetic field; a power supply; a tone generator; and an electric circuit powered by said power supply and arranged to activate said tone generator in response to an output from said magnetic field detector means, wherein said means for detecting an external magnetic field includes at least one pick-up having a piezoelectric material surrounded about its circumference by a thin layer of magnetostrictive material.

2. A tag as claimed in claim 1, wherein said tone generator is a piezoelectric tone generator.

3. A tag as claimed in claim 1, wherein a resonant acoustic enclosure for said tone generator is provided in the housing.

4. A tag as claimed in claim 1, wherein said electric circuit is a low-power CMOS integrated circuit.

5. A tag as claimed in claim 1, which further comprises attachment means whereby the tag can be attached to an article of merchandise, and which serves to activate the tone operator in the event of unauthorized removal of the tag.

6. An antipilferage system comprising a tag as claimed in claim 1, and an interrogating gate comprising a coil of electrically conductive material and an alternating current generator connected to said coil.

7. An active magnetic antipilferage tag attachable to a piece of merchandise which comprises a housing containing three pick-up coils disposed in mutual orthogonal directions for detecting an external magnetic field; a power supply; a tone generator, and an electric circuit powered by said power supply and arranged to activate said tone generator in response to an output from one or more of said pick-up coils.

* * * * *